US005675990A

United States Patent [19]

Kemper et al.

[11] Patent Number: 5,675,990

[45] Date of Patent: Oct. 14, 1997

[54] PILE FORMING WARP KNITTING MACHINE

[75] Inventors: Rainer Kemper, Obertshausertr; Jakob Weiland, Bretwiesenring, both of Germany

[73] Assignee: Karl Mayer Textilmachinenfabrik GmbH, Obertshausen, Germany

[21] Appl. No.: 651,743

[22] Filed: May 22, 1996

[30] Foreign Application Priority Data

May 26, 1995 [DE] Germany ..... 195 19 410.1

[51] Int. Cl.[6] ..... D04B 23/08

[52] U.S. Cl. ..... 66/83; 66/84 R; 66/204

[58] Field of Search ..... 66/83, 84 R, 204, 66/206

[56] References Cited

U.S. PATENT DOCUMENTS

| | | | |
|---|---|---|---|
| 2,143,609 | 1/1939 | Morton et al. | 66/204 |
| 4,986,091 | 1/1991 | Jager | 66/84 R |

FOREIGN PATENT DOCUMENTS

| | | |
|---|---|---|
| 2314432 | 10/1974 | Germany . |
| 2363021 | 3/1975 | Germany . |
| 2457950 | 6/1976 | Germany . |
| 4223226 | 11/1994 | Germany . |

OTHER PUBLICATIONS

German Office Action dated 28 Feb. 1996.

German Patent Abstract "Neue Pol–Kettenwirkmaschine mit vollelektronischer Steurung", pp. 272–274.

*Primary Examiner*—John J. Calvert

*Attorney, Agent, or Firm*—Omri M. Behr, Esq.

[57] ABSTRACT

A pile forming warp knitting machine having a spaced plurality of needles and a pair of separate sinker assemblies. These sinker assemblies have a plurality of pile sinkers and a plurality of enclosing, knock-over sinkers. Both pluralities of sinkers are interdigitated with the needles. The pile sinkers each have a distal edge and a proximal edge. The knock-over sinkers each have an enclosing recess. The knock-over sinkers also have (a) an exposed first segment with a knock-over edge, (b) a second segment integral with the first segment, and (c) an enclosing nose integral with the second segment and having an inside edge extending alongside the second segment at a predetermined distance therefrom. In a first working mode the knock-over sinkers reciprocate relative to the needles between an enclosing position and a knock-over position. The enclosing position is at the enclosing recess. The knock-over position is external to the enclosing recess. In the first working mode the knock-over sinkers can establish pile height based upon the spacing between the distal edge of the pile sinkers and the inside edge of the enclosing nose. In a second working mode the enclosing, knock-over sinkers are retained in the knock-over position. In this second working mode, the enclosing, knock-over sinkers can establish pile height based upon spacing between the distal edge and the proximal edge of the pile sinkers.

6 Claims, 3 Drawing Sheets

PILE FORMING WARP KNITTING MACHINE

BACKGROUND OF THE INVENTION

1. Field of the Invention

The present invention is concerned with a pile forming, warp knitting machine having pile sinkers and, in the needle spaces between the needles, a plurality of enclosing knock-over sinkers each having a knock-over edge with a first exposed segment and an enclosing nose located above a second segment thereof, wherein the enclosing, knock-over sinkers are reciprocatable relative to the needles between an enclosed position and a knock-over position with the pile height being determined by the separation between the distal edge of the pile sinker and the inside edge of the enclosing nose.

2. Description of Related Art

A warp knitting machine of this type is known from German Patent DE 42 23 226.C2. There the pile height may be altered to a certain extent in that the upper surface of the pile sinker may be displaced either by swinging or by lifting, or by the axial displacement of a wedge-shaped pile sinker. This mode limits the lower size of the pile height. If one wishes to produce even shorter pile, it is necessary to replace the enclosing, knock-over sinkers as well as the appropriate ground sinker bar with a complete set of knock-over sinkers and the appropriate ground sinker bar. This is tiresome and time-consuming.

An object of the present invention is to provide a pile forming, warp knitting machine of type known in the prior art, but in which larger pile height differences may be obtained in a simpler manner.

SUMMARY OF THE INVENTION

In accordance with the illustrative embodiments demonstrating features and advantages of the present invention, there is provided a pile forming warp knitting machine having a spaced plurality of needles and a plurality of pile sinkers mounted adjacent the needles. Each of the pile sinkers has a distal edge and a proximal edge. Also include are a plurality of enclosing, knock-over sinkers interdigitated with the needles. These knock-over sinkers each have an enclosing recess. Also, the knock-over sinkers each have (a) an exposed first segment with a knock-over edge, (b) a second segment, and (c) an enclosing nose located over the second segment and having an inside edge. The enclosing, knock-over sinkers in a first working mode are reciprocatable relative to the needles, between the enclosing recess and a knock-over position external to the enclosing recess, to establish pile height based upon spacing between the distal edge of the pile sinkers and the inside edge of the enclosing nose. The enclosing, knock-over sinkers can operate in a second mode to be retained in the knock-over position to establish pile height based upon spacing between the distal edge and the proximal edge of the pile sinkers.

Machines according to the foregoing principles can employ a second working mode wherein the enclosing, knock-over sinkers are kept in the knock-over position so that the pile height is determined by the distance between the distal edge and the proximal edge of the pile sinker. In this instance, functionally, the enclosing knock-over sinkers are converted into pure knock-over sinkers because they remain in the knock-over position. It is thus merely necessary to carry out a single holding action in order to obtain shorter pile.

Thus, the troublesome and time-consuming exchange of ground sinker bars no longer occurs. Nevertheless, the enclosing function of the enclosing knock-over sinkers is no longer present. This however is permissible since the pile sinkers take over the enclosing function.

It is advantageous to provide that the ground sinker bar carrying the enclosing, knock-over sinkers may, as desired, be connected either to a drive or to a fixed position by means of a detachable coupling means. In order to change from the first to the second working mode, one merely needs to loosen the coupling arrangement at one or a few places and to reconnect them, instead of to the drive, to a fixed position.

In such a preferred embodiment, the ground sinker bar is attached to levers and is swingable to and fro by the driving force of at least one driven rod. This driven rod is provided with a detachable able coupling arrangement, which may be connected selectively, either with a driving rod segment or with a segment rigidly attached to the machine. The driven rod is readily accessible. The attachment of the driven rod either to the driving rod segment or to the segment rigidly attached to the machine can be achieved by very simple hand grip motions.

It is structurally advantageous to provide that the driving rod segment is located at least partially inside the machine bed with its upper end outwardly directed. It is also advantageous if the rod segment that is rigidly attached to the machine is attached to the upper side of the machine bed. In such a position the detachable coupling means is readily accessible.

Furthermore, it is advantageous to provide that the driven rod contains an arrangement for adjusting its length. By means of such a setting arrangement, the enclosing knock-over sinker may be exactly adjusted both in the first and the second working mode with respect to the needles so that the pile formation occurs both in the first working mode in the enclosing setting and in the second working in the knock-over position.

BRIEF DESCRIPTION OF THE DRAWINGS

The present invention is illustrated in the drawings wherein the preferred embodiments shows as follows.

DETAILED DESCRIPTION OF THE PREFERRED EMBODIMENTS

Figure 1:
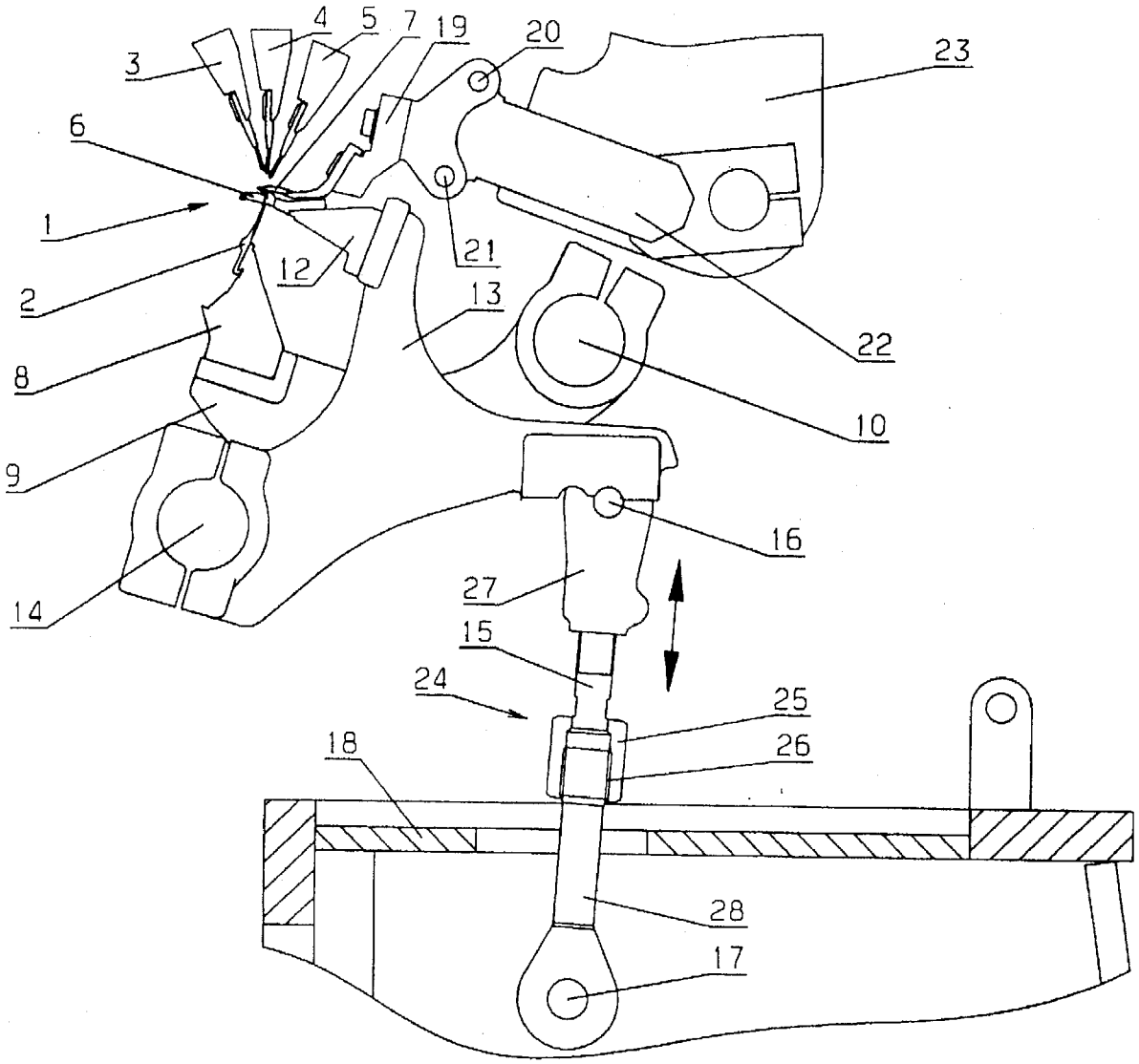
FIG. 1 is partial, side elevational view of a warp knitting machine according to the principles of the present invention, functioning in a first working mode.

Referring to FIG. 1, the warp knitting machine comprises a working area (1) having needles (2) in the form of slider needles, several rows of thread guides (3,4,5), enclosing knock-over sinkers (6) and pile sinkers (7).

The needles (2) sit on a needle bar (8), which is attached to lever (9), which is itself swingable about axis (10). The guides (3,4,5) each sit on a guide bar and swing through the needle spaces between the slider needles (2) and carry out overlaps and underlaps in the usual manner. The guides on at least one guide bar may be jacquard controlled and displaceable by one needle space.

The enclosing, knock-over sinkers (6), are located in the needle spaces between needles (2), and are carried by a guide bar (12), which is attached to lever (13) and is swingable about an axis (14). Lever (13) is connected to a driven member (15), which is connected to said lever (13) via a hinge (16) and via another hinge (17), which is part of a bar drive powered by a main-shaft-driven eccentric cam (not shown) within the machine bed (18).

The pile sinkers (7) located above the enclosing knock-over sinkers (6) are carried by a pile sinker bar (19), which is connected to hanger means (23) via guides (20 and 21) through carrier (22). Bar (19) is displaceable parallel to the row of needles (2).

When the threads running through guides (3, 4 and 5) cross over the pile sinker (7) during the underlap, a pile loop is obtained. When however, the guides and the pile sinkers are displaced in the same direction, no pile formation will occur.

Figure 2:
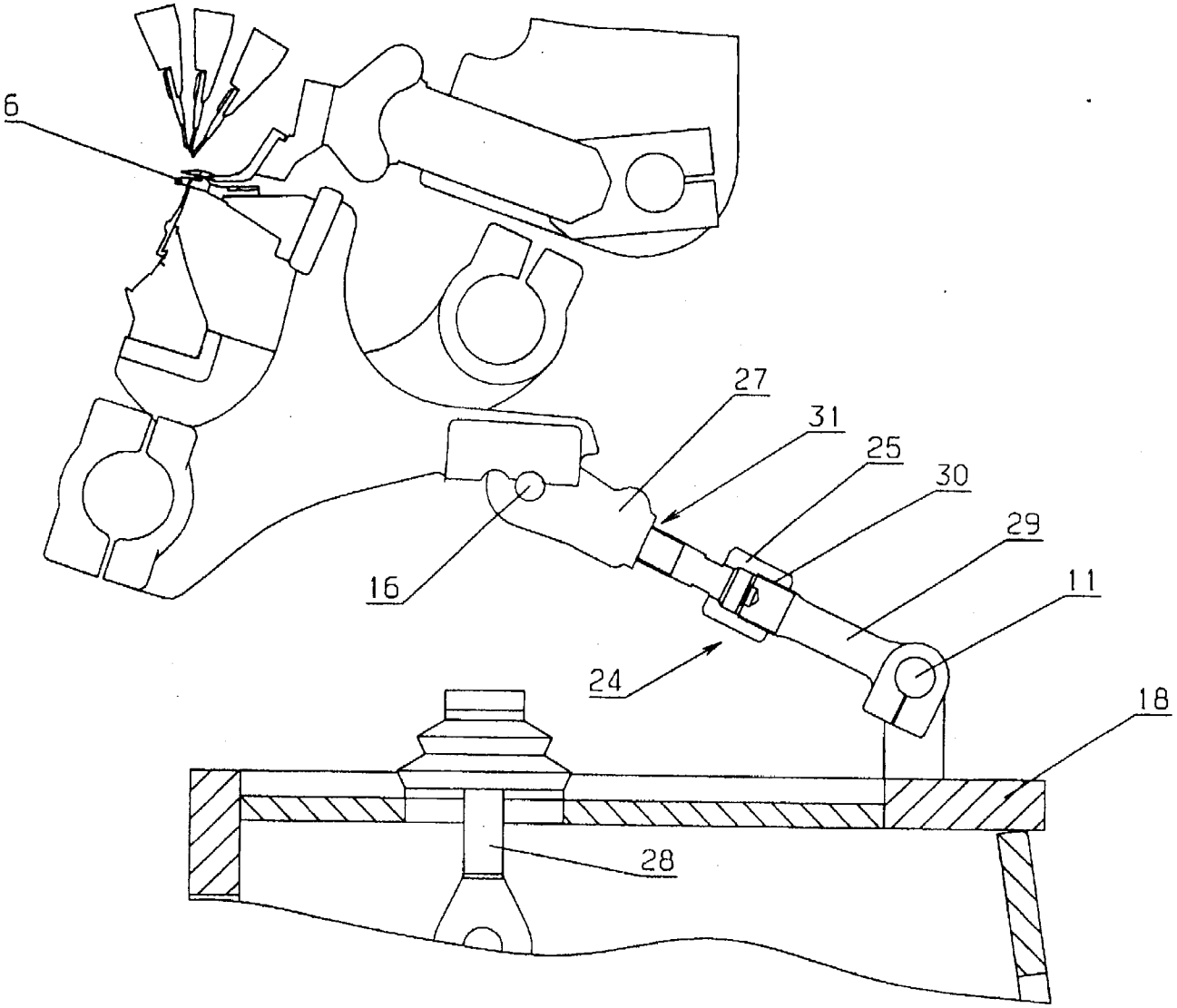
FIG. 2 shows the warp knitting machine of FIG. 1 functioning in the second working mode.

The rod (15) includes a detachable coupling arrangement (24). By loosening nut (25), the bar-side rod segment (27) is separated from a drive-side segment (28). As shown in FIG. 2, the bar-side rod portion (27) may be connected with a machine-side borne rod segment (29). For this second working mode, nut (25) is threaded onto the threads (30) of segment (29). The rod segment (29) is held stationary in a bearing (anchor 11) on the upper side of the machine bed (18).

In the setting shown in FIG. 2, the enclosing knock-over sinker (6) is held tight to the machine. By the assistance of a setting means (31) which comprises a threaded bolt and corresponding female thread, the distance between hinge (16) and bearing (11) may be adjusted in order to ensure the exact position of the knock-over sinker (6). In a similar manner, the setting means (31) can serve to set the position of the enclosing knock-over sinker (6) in the first working mode. In the second working mode of FIG. 2, the drive-side rod segment (28) can be fitted with a cover, in particular a bellows cover, in order to isolate the machine bed (18) and to contain the rod segment (28).

Figure 3:
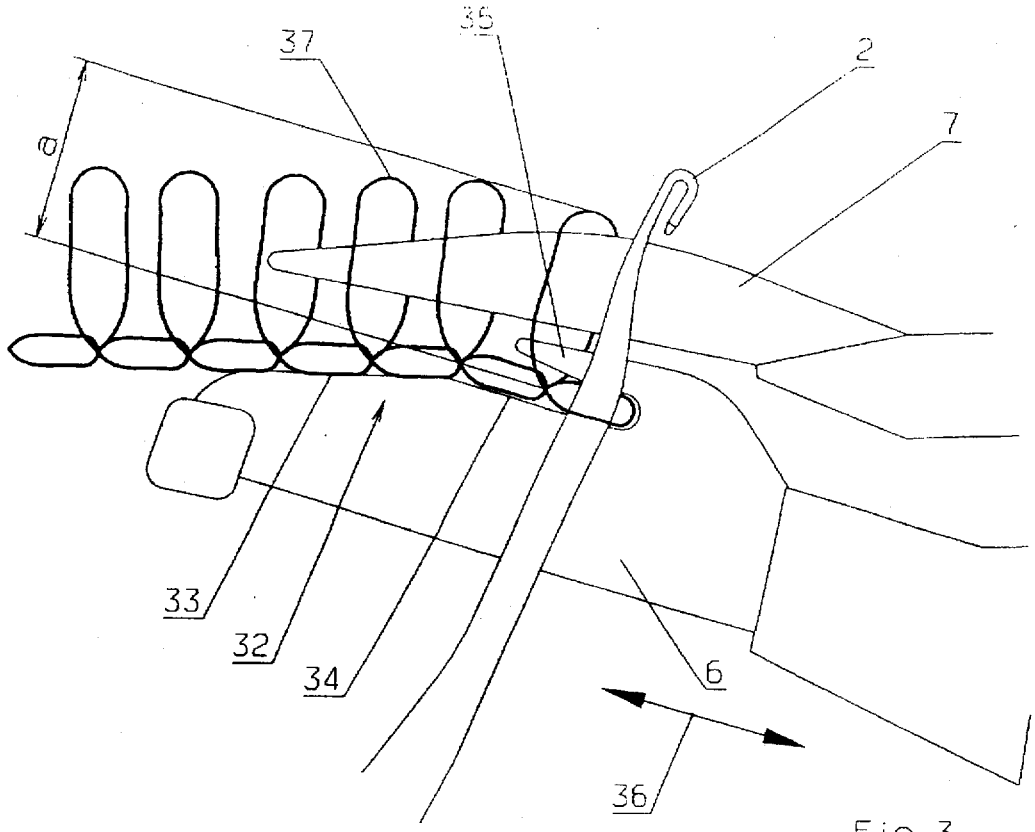
FIG. 3 shows the work area for the first working mode of FIG. 1.

FIG. 3 corresponds to the first working mode in accordance with FIG. 1. The enclosing, knock-over sinker (6) has a knock-over edge (32) which has a first exposed segment (33) and a second segment (34), over which is located an enclosing nose (35). The reciprocating motion of the enclosing knock-over sinker is indicated by arrow (36). Its forwardmost position as shown in FIG. 3, corresponds to a enclosing setting, in which the needle (2) crosses the enclosing nose (35). When a thread (37) laid by guides (that is, guides 3, 4 or 5 of FIG. 1) crosses a pile sinker (7), a pile loop is obtained whose height is determined by the separation between the inside edge (the lower edge in this view) of the enclosing nose (35) and the distal edge (upper edge in this view) of pile sinker (7). In accordance with the setting of the pile sinker (7) with reference to the enclosing knock-over sinker (6), this leads to a pile height "a" of between 2.5 and 5 mm. This height may be varied therefrom, in that the pile sinker (7) may be displaced in its longitudinal direction or its height setting may be displaced or swung.

Figure 4:
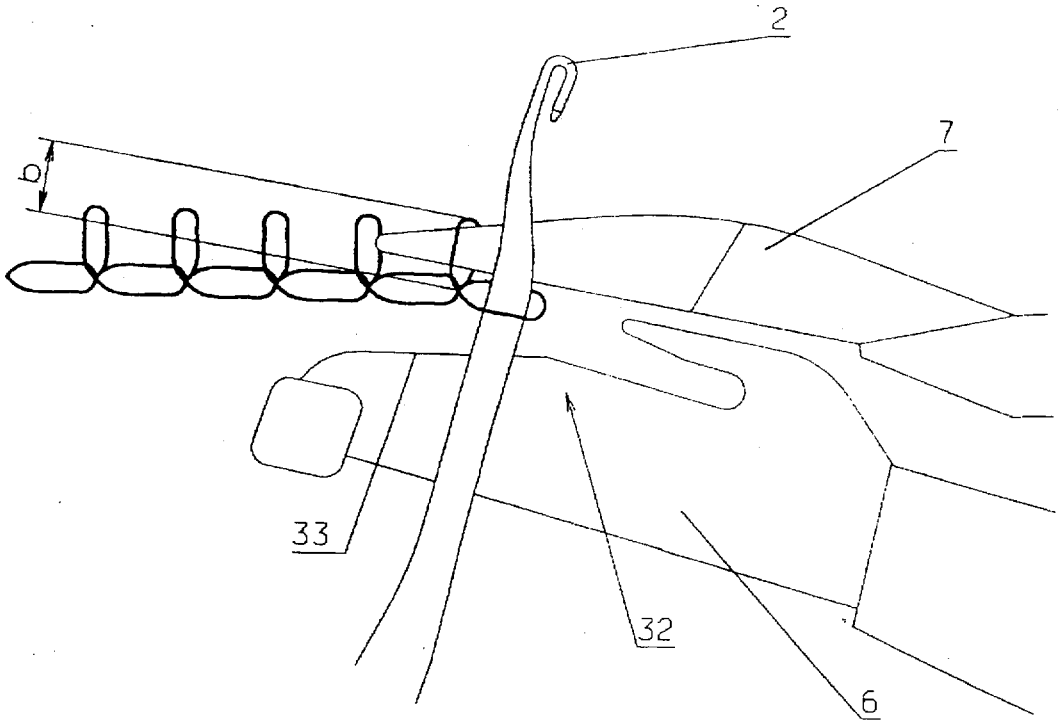
FIG. 4 shows the work area for the second working mode of FIG. 2.

In the second working mode in accordance with FIG. 2, the circumstances shown in FIG. 4 will occur. The enclosing knock-over sinker (6) is held in a knock-over setting, in which the needle (2) is oriented at segment (33) of knock-over edge (32). In this setting, a pile of height of "b" is obtained from the space between the proximal (lower) edge and the distal (upper) edge of the pile sinker (7). In this manner, one obtains a comparatively small pile height of between 0.5 and 2.5 mm. In order to vary the pile height within the these parameters, pile sinker (7) may be moved along its longitudinal axis.

When the fabric ground is laid as fringe with magazine weft insert, the pile sinkers (7) can be rigidly affixed to the machine. A pile is then obtained when the pile threads are laid as tricot or with an even larger underlap displacement. However, one can also provide that the pile sinkers (7) are displaceable when it is arranged that during the laying of the fabric ground, the same displacement occurs, for example, during the displacement of the pile sinker by one needle space to and fro, the fabric ground also lays tricot. All different lappings, for example, fringe or tuch lead to pile formation.

We claim:

1. A pile forming warp knitting machine comprising:

a spaced plurality of needles; and a pair of separate sinker assemblies including:

a plurality of pile sinkers interdigitated with said needles and each having a distal edge and a proximal edge; and a plurality of enclosing, knock-over sinkers interdigitated with the needles, said knock-over sinkers each having an enclosing recess, said knock-over sinkers each having (a) an exposed first segment with a knock-over edge, (b) a second segment integral with said first segment, and (c) an enclosing nose integral with said second segment and having an inside edge extending alongside said second segment at a predetermined distance therefrom, the enclosing knock-over sinkers in a first working mode being reciprocatable relative to the needles between an enclosing position and a knock-over position, the enclosing position being at the enclosing recess, the knock-over position being external to the enclosing recess, the knock-over sinkers being operable in said first working mode to establish pile height based upon spacing between the distal edge of the pile sinkers and the inside edge of the enclosing nose, the enclosing, knock-over sinkers being operable in a second working mode to be retained in the knock-over position, the enclosing, knock-over sinkers being operable in said second working mode to establish pile height based upon spacing between the distal edge and the proximal edge of the pile sinkers.

2. Warp knitting machine in accordance with claim 1, comprising:

a bar drive; and a ground sinker bar carrying the enclosing, knock-over sinkers and adapted to be selectively connected and disconnected to said bar drive, said ground sinker bar being adapted to be held stationary when disconnected from said bar drive.

3. Warp knitting machine in accordance with claim 2, comprising:

a fixed anchor;

a detachable coupling arrangement for selectively connecting said ground sinker bar to said fixed anchor or said bar drive.

4. Warp knitting machine in accordance with claim 2, comprising:

an anchor rigidly affixed to the machine;

a sinker lever pivotally mounted at said machine for supporting and reciprocating said ground sinker bar;

a driven member coupled to said lever for reciprocating said sinker lever;

a detachable coupling arrangement for selectively connecting and disconnecting said driven member to either said anchor or said bar drive.

5. Warp knitting machine in accordance with claim 4, wherein said machine includes a machine bed, said bar drive comprising:

a drive side segment attached inside said machine bed to project outwardly, said anchor being rigidly affixed atop the machine bed and having a linking segment adapted to connect through said detachable coupling to said driven member.

6. Warp knitting machine in accordance with claim 2, comprising:

a driven member drivingly coupled to said ground sinker bar and having a setting means for controlling effective length of said driven member.

* * * * *